US012655543B2

(12) United States Patent
Juikar et al.

(10) Patent No.: US 12,655,543 B2
(45) Date of Patent: Jun. 16, 2026

(54) HYDROPHOBIC CELLULOSIC FIBER

(71) Applicant: GRASIM INDUSTRIES LIMITED, Ujjain (IN)

(72) Inventors: Vishvajit Chandrakant Juikar, Navi Mumbai (IN); Nilesh Guruling Waghmare, Navi Mumbai (IN); Kundan Sambhaji Jangam, Navi Mumbai (IN)

(73) Assignee: GRASIM INDUSTRIES LIMITED, Nagda (IN)

( * ) Notice: Subject to any disclaimer, the term of this patent is extended or adjusted under 35 U.S.C. 154(b) by 516 days.

(21) Appl. No.: 18/262,571

(22) PCT Filed: Jan. 17, 2022

(86) PCT No.: PCT/IB2022/050334
§ 371 (c)(1),
(2) Date: Jul. 22, 2023

(87) PCT Pub. No.: WO2022/157609
PCT Pub. Date: Jul. 28, 2022

(65) Prior Publication Data

US 2024/0110316 A1 Apr. 4, 2024

(30) Foreign Application Priority Data

Jan. 22, 2021 (IN) ..... 202121003117

(51) Int. Cl.
*D06M 13/00* (2006.01)
*D01F 2/06* (2006.01)
(Continued)

(52) U.S. Cl.
CPC ..... *D01F 11/02* (2013.01); *D01F 2/06* (2013.01); *D06M 13/228* (2013.01); *D06M 15/11* (2013.01); *D06M 15/3562* (2013.01)

(58) Field of Classification Search
CPC . D01F 11/02; D01F 2/06; D01F 11/00; D01F 2/08; D01F 1/10; D06M 13/228;
(Continued)

(56) References Cited

U.S. PATENT DOCUMENTS 2,791,484 A * 5/1957 Cafasso ..... D06M 13/13 536/63
10,442,870 B2 * 10/2019 Hashizume ..... C08B 3/16
2014/0315461 A1 * 10/2014 Schachtner ..... D06M 13/228 106/203.3

FOREIGN PATENT DOCUMENTS

AT 512143 B1 * 12/2013 ..... D06M 13/13
JP 2010106251 A 5/2010
WO 2022157609 A8 9/2022

OTHER PUBLICATIONS

STIC Search Report dated Feb. 10, 2026.*
(Continued)

*Primary Examiner* — Eisa B Elhilo
(74) *Attorney, Agent, or Firm* — Franklin & Associates International Inc; Matthew F. Lambrinos

(57) ABSTRACT

The present disclosure relates to a continuous process for preparing hydrophobic regenerated cellulosic fiber. Said process comprises treating never-dried cellulosic fiber with a hydrophobic composition comprising 0.05-2.5 weight % of an alkyl ketene dimer based on weight of cellulose. The alkyl ketene dimer has a formula I: wherein both $R_1$ and $R_2$ are hydrocarbon groups having 8-40 carbon atoms and which can be both, saturated or unsaturated, straight-chained or branched. The hydrophobic composition further comprises 0.02-1 weight % of a cationic polymer based on weight of cellulose. After treatment with the hydrophobic composition, the treated fiber is subjected to a drying step to form hydrophobic regenerated cellulose fiber.
(Continued)

I

20 Claims, 2 Drawing Sheets

(51) Int. Cl.

| | |
|---|---|
| ***D01F 11/02*** | (2006.01) |
| ***D06M 13/228*** | (2006.01) |
| ***D06M 15/11*** | (2006.01) |
| ***D06M 15/356*** | (2006.01) |

(58) Field of Classification Search
CPC ..... D06M 15/11; D06M 15/3562; D06M 15/285; C08L 1/10; C08B 3/10; D10B 2201/20; D10B 2509/00
USPC ..... 8/115.51
See application file for complete search history.

(56) References Cited

OTHER PUBLICATIONS

International Search Report issued Apr. 22, 2022, on a PCT No. PCT/IB2022/050334, filed Jan. 17, 2022.
Written Opinion issued Apr. 22, 2022, on a PCT No. PCT/IB2022/050334, filed Jan. 17, 2022.

* cited by examiner

HYDROPHOBIC CELLULOSIC FIBER

CROSS-REFERENCE TO RELATED APPLICATIONS

The present application is a national stage of International Application No. PCT/IB2022/050334, filed Jan. 17, 2022, which claims the priority to Indian Patent Application number 202121003117, filed Jan. 22, 2021, each of which is incorporated by reference herein in its entirety.

FIELD OF INVENTION

The present disclosure relates to hydrophobic regenerated cellulosic fiber and a continuous process for production of said hydrophobic regenerated cellulosic fiber. Specifically, the present disclosure relates to hydrophobic regenerated cellulosic fiber having desired frictional properties.

BACKGROUND

Natural cellulosic fibers and man-made cellulosic fibers (MMCFs), such as viscose, modal, lyocell are hydrophilic due to the presence of numerous hydroxyl groups in its structure, while synthetic fiber such as nylon and polyester are permanently hydrophobic. This water-loving tendency of cellulosic fibers limit their application. For instance, in the current market of hygiene products, polypropylene and polyester are mostly used due to their hydrophobic properties. Said synthetic fibers are not environment friendly derived while cellulosic fibers are derived from eco-friendly raw material and are biodegradable. Thus, for sustainability reasons, cellulosic fibers and man-made cellulosic fibers are becoming attractive and the focus is now shifting to use cellulosic fibers in more and more segments.

Many different hydrophobic agents/compositions are currently being used at fabric stage to impart water repellency, for example, silicone chemistry (trimethoxy base), alkyl urethane base, fluorocarbon base, nanotechnology base. These chemicals are applied at fabric stage and either they are expensive or not suitable for fiber application. Also, some of them are hazardous to environment when discharged as effluent.

US20140315461A1 discloses a cellulosic fiber comprising a hydrophobic agent. Said hydrophobic agent may be alkyl ketene dimer (AKD) or substituted cyclic dicarboxylic acid anhydrides like substituted succinic or glutaric acid anhydrides and similar. The resulting hydrophobic fibers are bulky and extra soft.

WO 2013/067555 A1 discloses a cellulosic fiber comprising a hydrophobic agent. Said hydrophobic agent may be alkyl ketene dimer (AKD) or substituted cyclic dicarboxylic acid anhydrides like substituted succinic or glutaric acid anhydrides and similar. The resulting fiber has an oil-uptake which is at least 2 times higher than the oil-uptake of an untreated fibre.

SUMMARY

The present disclosure relates to a continuous process for preparing hydrophobic regenerated cellulosic fiber. Particularly, the disclosed process comprises treating never-dried cellulosic fiber with a hydrophobic composition comprising 0.05-2.5 weight % of an alkyl ketene dimer based on weight of cellulose, the alkyl ketene dimer having a formula I:

formula I

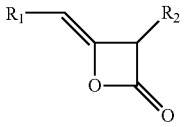

wherein both $R_1$ and $R_2$ are hydrocarbon groups having 8-40 carbon atoms and which can be both, saturated or unsaturated, straight-chained or branched; and 0.02-1 weight % of a cationic polymer based on weight of cellulose. This treatment is followed by a drying step to dry the treated fiber to form hydrophobic regenerated cellulose fiber.

A hydrophobic regenerated cellulosic fiber is also disclosed. Said hydrophobic regenerated cellulosic fiber comprises a hydrophobic composition absorbed thereon. The hydrophobic composition comprises of about 0.05-2.0 weight % of an alkyl ketene dimer based on weight of cellulose, the alkyl ketene dimer having a formula I:

formula I

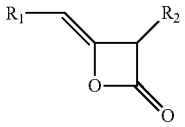

wherein both $R_1$ and $R_2$ are hydrocarbon groups having 8-40 carbon atoms and which can be both, saturated or unsaturated, straight-chained or branched. The hydrophobic composition further comprises about 0.08-0.5 weight % of a cationic polymer. The hydrophobic regenerated cellulosic fiber has a fiber-fiber friction of at least 7.0 N (peak at force), measured in accordance with sledge test (ANSI/ASTM D 1894-78).

DETAILED DESCRIPTION

Figure 1A:
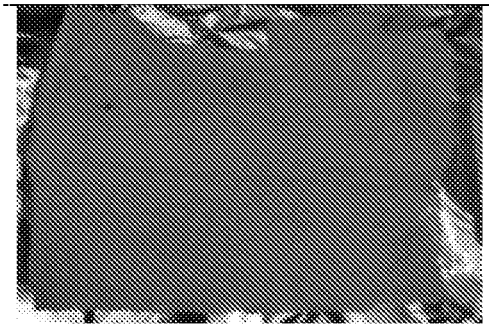
FIGS. 1A, 1B, 1C and 1D show the camera images of regular VSF (Viscose Staple Fiber) fabric when subjected to soil degradation at $1^{st}$, $2^{nd}$, $3^{rd}$ and $4^{th}$ week respectively.
Figure 1B:
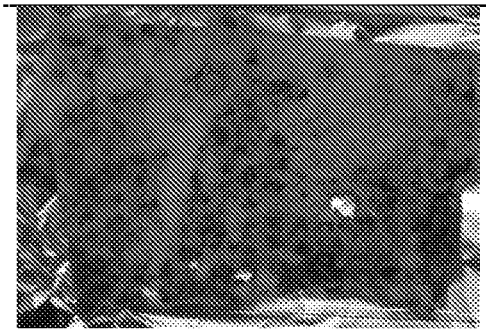
Figure 1C:
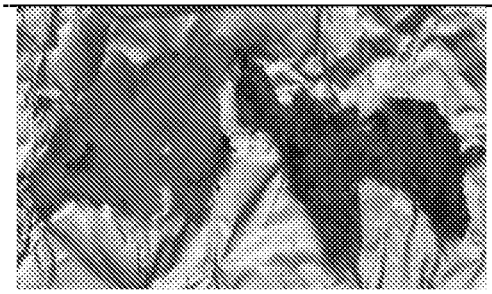
Figure 1D:
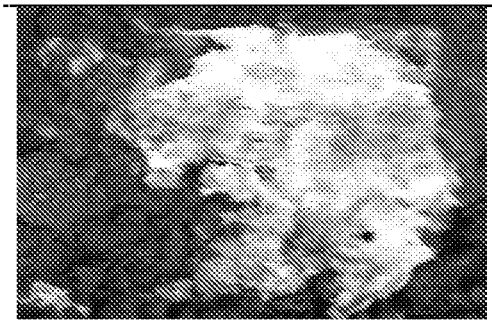
Figure 2A:
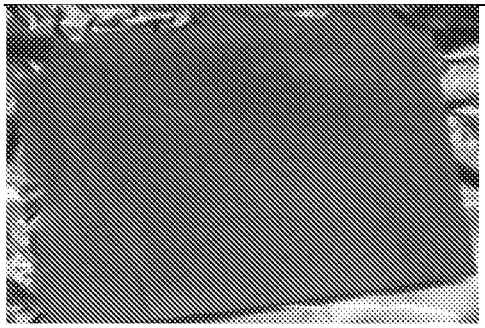
FIGS. 2A, 2B, 2C and 2D and show the camera images of 100% hydrophobic VSF fabric when subjected to soil degradation at $1^{st}$, $2^{nd}$, $3^{rd}$ and $4^{th}$ week respectively.
Figure 2B:
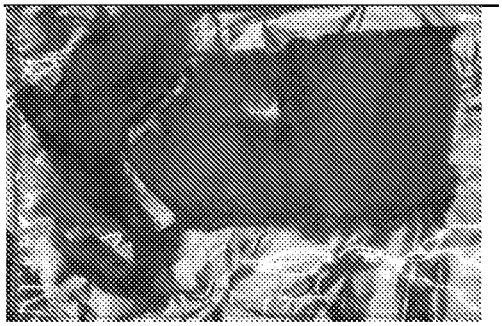
Figure 2C:
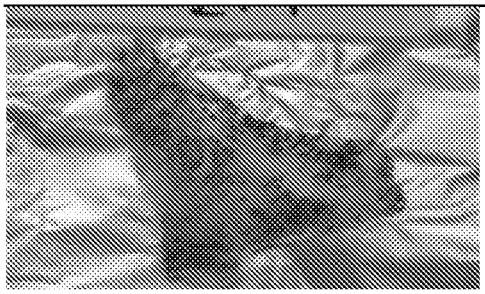
Figure 2D:
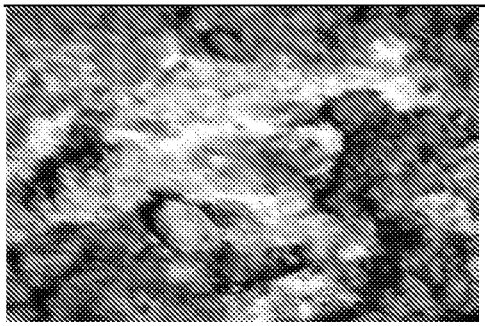

For the purpose of promoting an understanding of the principles of the disclosure, reference will now be made to embodiments and specific language will be used to describe the same. It will nevertheless be understood that no limitation of the scope of the disclosure is thereby intended, such alterations and further modifications in the disclosed composition and method, and such further applications of the principles of the disclosure therein being contemplated as would normally occur to one skilled in the art to which the disclosure relates.

It will be understood by those skilled in the art that the foregoing general description and the following detailed description are exemplary and explanatory of the disclosure and are not intended to be restrictive thereof.

Reference throughout this specification to "one embodiment" "an embodiment" or similar language means that a particular feature, structure, or characteristic described in connection with the embodiment is included in at least one embodiment of the present disclosure. Thus, appearances of the phrase "in one embodiment", "in an embodiment" and similar language throughout this specification may, but do not necessarily, all refer to the same embodiment.

In its broadest scope, the present disclosure relates to a continuous process for preparing hydrophobic regenerated cellulosic fiber. Particularly, the disclosed process comprises treating never-dried cellulosic fiber with a hydrophobic composition comprising:

0.05-2.5 weight % of an alkyl ketene dimer based on weight of cellulose, the alkyl ketene dimer having a formula I:

formula I

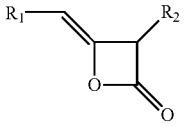

wherein both $R_1$ and $R_2$ are hydrocarbon groups having 8-40 carbon atoms and which can be both, saturated or unsaturated, straight-chained or branched;

0.02-1 weight % of a cationic polymer based on weight of cellulose.

This treatment is followed by a drying step to dry the treated fiber to form hydrophobic regenerated cellulose fiber.

A hydrophobic regenerated cellulosic fiber is also disclosed. Said hydrophobic regenerated cellulosic fiber comprises a hydrophobic composition absorbed thereon. The hydrophobic composition comprises of about 0.05-2.0 weight % of an alkyl ketene dimer based on weight of cellulose, the alkyl ketene dimer having a formula I:

formula I

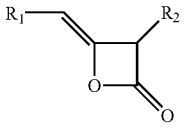

wherein both $R_1$ and $R_2$ are hydrocarbon groups having 8-40 carbon atoms and which can be both, saturated or unsaturated, straight-chained or branched. The hydrophobic composition further comprises about 0.08-0.5 weight % of a cationic polymer. The hydrophobic regenerated cellulosic fiber has a fiber-fiber friction of at least 7.0 N (peak at force), measured in accordance with sledge test (ANSI/ASTM D 1894-78).

It has been found by the present inventors that the treatment of cellulosic fibers with the disclosed hydrophobic composition introduces hydrophobic moiety on the cellulosic fiber while maintaining the frictional properties of the fibers in the desired range. In particular, it has been found that the treatment of regenerated cellulosic fibers with hydrophobic composition comprising alkyl ketene dimer results in extra soft fibers having very low fiber-fiber friction. This made the resultant hydrophobic fibers not suitable for processing in regular machinery for production of various nonwoven articles or fabrics. The disclosed composition and process enables achieving hydrophobic regenerated cellulosic fibers with frictional properties similar or closer to commercial grade viscose fiber (i.e., without treatment with the hydrophobic agents). Thus, the disclosed hydrophobic fiber can be processed in regular machinery for production of various nonwoven articles or fabrics.

In accordance with an aspect, the disclosed process results in a cellulosic fiber having a fiber-fiber friction of at least 7.0 N (peak at force), measured in accordance with sledge test (ANSI/ASTM D 1894-78). In accordance with an embodiment, the resultant cellulosic fiber has a fiber-fiber friction in a range of 7-14 N.

In accordance with an embodiment, the hydrophobic composition is in the form of an emulsion. In accordance with yet another embodiment, the hydrophobic composition has a solid content in a range of 15-35%, and preferably 20-30%.

In accordance with an embodiment, the alkyl ketene dimer has a formula I:

formula I

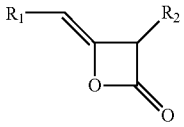

wherein both $R_1$ and $R_2$ are hydrocarbon groups having 8-40 carbon atoms and which can be both, saturated or unsaturated, straight-chained or branched. In accordance with yet another embodiment, the hydrophobic composition comprises the alkyl ketene dimer in an amount ranging between 0.05-2.5% based on weight of cellulose. Preferably, the hydrophobic composition comprises the alkyl ketene dimer in an amount ranging between 0.2-1.5% based on weight of cellulose. The alkyl ketene dimer solution may be obtained from any commercial sources such as HERCON 196 (from Solenis, India), NTP AKD emulsion (from New tech polymers, India), Novasize-1500 AKD (from NNOWETA, India), 25% AKD emulsion (from Weifang great land chemicals co., ltd. China).

In accordance with an embodiment, the cationic polymer is a polymeric quaternary ammonium compound selected from a group consisting of Poly(diallyldimethylammonium chloride), Poly(acrylamide-co-diallyldimethylammonium chloride) and cationic starch (from Everest Starch India Pvt. Ltd.). In accordance with an embodiment, the hydrophobic composition comprises the cationic polymer such as Poly-DADMAC (from Hifix Nfi by ROSSARI BIOTECH LIMITED) in an amount ranging between 0.02-1 weight % based on weight of cellulose and preferably between 0.08-0.6 weight % based on weight of cellulose.

In accordance with an embodiment, the hydrophobic composition further comprises a metal salt. It was found by the inventors that when said alkyl ketene dimer and cationic polymer are further combined with a metal salt, said combination provides a further synergistic effect thereby imparting the treated fiber with improved frictional properties and hydrophobicity which is suitable for producing nonwoven products with higher productivity.

In accordance with an embodiment, the metal salt is selected from a group consisting of aluminum sulphate, magnesium sulphate, sodium sulphate, sodium chloride. In accordance with an embodiment, the hydrophobic composition comprises 0.01-0.5 weight % of the metal salt such as aluminium sulpahte based on weight of cellulose, and preferably between 0.04-0.35% based on weight of cellulose.

Said hydrophobic composition is prepared by mixing the alkyl ketene dimer, cationic polymer and optionally the metal salt in the desired percentage.

In accordance with an embodiment, the regenerated cellulosic fiber is selected from a group consisting of viscose fiber, modal fiber, lyocell fiber, pigmented fiber, colored dope dyed fiber, short cut fiber, trilobal/multi-lobal fiber and material incorporated fiber. Herein, the material incorporated fibers include but are not limited to cellulosic fibers comprising one or more of a metal, metal oxide, flame retardant, ion exchange resin, polymeric additives, carbon black.

In accordance with an embodiment, the treatment is carried by pouring or spraying the hydrophobic composition on the unfinished fiber for a predetermined time-period. In accordance with yet another embodiment, said treatment is carried out for a time-period of seconds to 5 minutes, and preferably for 1-2 minutes.

Said treatment may be carried out in any conventional apparatus used for commercial manufacturing of various regenerated cellulosic fibers, such as application of spin finish to fiber.

A product comprising the disclose hydrophobic regenerated cellulosic fiber is also disclosed. In accordance with an embodiment, said product is a multi-layer article and comprises a top layer or sheet comprising said hydrophobic regenerated cellulosic fiber. In accordance with an embodiment, product is selected from the group consisting of sanitary products, medical products, papers, wet-laid nonwovens, textile products, packaging articles, nonwoven fabrics, filter media and the like.

In order that this invention may be better understood, the following examples are set forth. These examples are for the purpose of illustration only and the exact compositions, methods of preparation and embodiments shown are not limiting of the invention, and any obvious modifications will be apparent to one skilled in the art.

EXAMPLES

Characterization Methods

1) Sledge test (ANSI/ASTM D 1894-78): The method is used for measurement of frictional properties of fiber. This test is particularly applicable for determination of fiber/fiber friction and degree of scroop—the stick/slip phenomenon.
   For measurement of fiber-fiber friction: Sample of the substrate under test is laid on an emery-paper-covered bed, and a smaller sample of the same is placed on top of it. An emery-paper-covered block is placed squarely on the smaller sample and weighted. A wire is attached to the block and the Instron machine operated. The force on the wire required to move the block and upper sample is measured by the load cell, and a graph is plotted of force against load.
   For measurement of Fiber-metal friction: The test is carried out as for fiber-fiber friction, except that instead of a second sample of the substrate being used, a weighted chrome steel sledge is employed as the friction surface.
   Both methods yield test results with an accuracy of approximately 5%. Five determinations per sample are usually carried out and the mean value is quoted. Further, the softer fiber surface needed less power and harsher fiber needs more power to pull the sledge forward. Similarly, "scroop" and "peak at force" define cohesion of the fiber. The lower the value, the softer and slippery is fiber.
2) Liquid Strike-Through test method (EDANA/INDA-standards WSP 70.3): This test is used to determine the time taken for a known volume of liquid to pass through a nonwoven that is in contact with an underlying dry standard absorbent pad. The test specimen is placed on the instrument over which a predetermined amount of test fluid is poured. The time taken for the specimen to completely absorb the fluid is measured. This is the liquid strike through time.
3) Wet Back test (Wet back by EDANA/INDA standards WSP 80.10): The wetback test is performed by placing a load which is approximately a baby's weight over the sample. The weight of the sample after rewetting is measured. This is the wetback value.
4) Liquid wicking rate (Method:—ISO 9073): Liquid wicking test is used to determine the rate of water transport measured according to a vertical strip wicking test. One end of a fabric strip is secured vertically while the opposite end dangles in a dish containing distilled water. The height to which the water was transported along the strip is measured at intervals of 1, 5, and 10 minutes, and reported in centimeters (cm). Higher wicking values show greater capability for transporting liquid water.
5) Spray Test (Water Repellency of fabric Spray Test Rating (IS 390: 1975: RA2013): This test measures "resistance to wetting" and is determined by the ability of a fabric to absorb water, which is in contact with the same, in form of rain.
6) Biodegradability test: To prepare test soil, a compost was prepared by mixing thoroughly fertile garden soil, cow dung manure and sand in the proportion of 2:1:1 by weight. The mixture was passed through sieve and moisture content was adjusted to 25-27%.

Comparative Example 1: 20 grams of wet (100% moisture on dry fiber basis) unfinished (finish never applied) viscose staple fiber has been taken for the application. 200 ml water containing 1% fluorocarbon emulsion (from "Nuva N2114 Archoma") on active basis was poured/sprayed on fiber using Material-to-liquor ratio (MLR)-1:20, for 2 minutes. Further, this fluorocarbon applied fiber was passed through padding mangle to control final moisture 100% on dry fiber basis (fluorocarbon 1% on fiber), followed by drying at 130° C. for 20 minutes in oven.

It was observed that the resultant fiber showed very good hydrophobicity and frictional attributes for the said fiber was significantly affected as compared to standard viscose (commercial grade) fiber.

Example 1

TABLE 1

Composition of hydrophobic composition-INV1 (Solid content-25-30%)

| Ingredients | Quantity (%) in water |
|---|---|
| AKD emulsion (solids), commercial grade | 15-20 |
| Aluminum sulfate | 4 |
| poly-DADAMAC | 6 |

20 grams of wet (100% moisture on dry fiber basis) unfinished (finish never applied) viscose staple fiber (VSF) has been taken for the application. 200 ml water containing 1% hydrophobic composition-INV1 on active (solids) basis was poured/sprayed on fiber using MLR-1:20, for 2 minutes. Further, this treated fiber was passed through padding mangle to control final moisture 100% on dry fiber basis (INV1% on fiber). Then the fiber was dried at 105° C. for 20 minutes in oven.

It was observed that the resultant fiber showed good hydrophobicity and frictional attributes for the said fiber were found to be comparable to standard viscose (commercial grade) fiber.

Example 2

20 grams of wet (100% moisture on dry fiber basis) unfinished (finish never applied) viscose staple fiber has been taken for the application. 200 ml water containing 0.5% INV1 on active (solids) basis was poured/sprayed on fiber using MLR-1:20, for 2 minutes. Further, this treated fiber was passed through padding mangle to control final moisture 100% on dry fiber basis (INV1 0.5% on fiber). Then the fiber was dried at 105° C. for 20 minutes in oven.

It was observed that the resultant fiber showed medium hydrophobicity and frictional attributes for the said fiber were found to be comparable to standard viscose (commercial grade) fiber.

Example 3

20 gm of wet (100% moisture on dry fiber basis) unfinished (finish never applied) viscose staple fiber has been taken for the application. 200 ml water containing 0.25% INV1 on active (solids) basis was poured/sprayed on fiber using MLR-1:20, for 2 minutes. Further, this treated fiber was passed through padding mangle to control final moisture 100% on dry fiber basis (INV1 0.25% on fiber). Then the fiber was dried at 105° C. for 20 minutes in oven.

It was observed that the resultant fiber showed low hydrophobicity and frictional attributes for the said fiber were found to be comparable to standard viscose (commercial grade) fiber.

Example 4

20 gm of wet (100% moisture on dry fiber basis) dull nonwoven unfinished (finish never applied) viscose staple fiber has been taken for the application. 200 ml water containing 1% INV1 on active (solids) basis was poured/sprayed on fiber using MLR-1:20, for 2 minutes. Further, this treated fiber was passed through padding mangle to control final moisture 100% on dry fiber basis (INV1 1% on fiber). Then the fiber was dried at 105° C. for 20 minutes in oven.

It was observed that the resultant fiber showed good hydrophobicity and frictional attributes that are comparable to standard nonwoven viscose (commercial grade) fiber.

Example 5

20 gm of wet (100% moisture on dry fiber basis) unfinished (finish never applied) Birla excel (Lyocell) staple fiber has been taken for the application. 200 ml water containing 1% INV1 on active (solids) basis was poured/sprayed on fiber using MLR-1:20, for 2 minutes. Further, this treated fiber was passed through padding mangle to control final moisture 100% on dry fiber basis (INV1 1% on fiber). Then the fiber was dried at 105° C. for 20 minutes in oven.

It was observed that the resultant fiber showed good hydrophobicity and frictional attributes for the said fiber were found to be comparable to standard Birla excel (Lyocell commercial grade) fiber.

Example 6

20 gm of wet (100% moisture on dry fiber basis) unfinished (finish never applied) dope dyed viscose staple fiber has been taken for the application. 200 ml water containing 1% INV1 on active (solids) basis was poured/sprayed on fiber using MLR-1:20, for 2 minutes. Further, this treated fiber was passed through padding mangle to control final moisture 100% on dry fiber basis (INV1 1% on fiber). Then the fiber was dried at 105° C. for 20 minutes in oven.

It was observed that the resultant fiber showed good hydrophobicity and frictional attributes for the said fiber were found to be comparable to standard dope dyed (commercial grade) fiber.

Table 2 shows the hydrophobic rating of the fibers obtained in above comparative example 1 and examples 1-6, by observing fiber hydrophobicity for 24 hours. The higher the hydrophobic rating, higher is the hydrophobic properties of the fiber. Herein, if the fiber floats on water for 24 hours without absorption then the fiber is given a rating of 10.

TABLE 2

Hydrophobic rating of fibers

| Example (Ex) No. | Hydrophobic rating |
|---|---|
| Comp. Ex. 1- Viscose + 1% Fluorocarbon (Nuva N2114, Archoma) | 10 |
| Standard Viscose (Control) | 0 |
| Ex. 1- Viscose + 1% INV1 | 10 |
| Ex. 2- Viscose + 0.5% INV1 | 8 |
| Ex. 3- Viscose + 0.25% INV1 | 5 |
| Ex. 4-Viscose (Dull non-woven) + 1% INV1 | 10 |
| Ex. 5- Lyocell + 1% INV1 | 10 |
| Ex. 6- Dope dyed + 1% INV1 | 9 |

Table 3 shows the frictional properties of the fibers obtained in above comparative example 1 and examples 1-6.

TABLE 3 frictional properties of fiber

| Example (Ex) No. | Peak at Force (N) | Scroop (N) |
|---|---|---|
| Comp. Ex. 1- Viscose + 1% Fluorocarbon (Nuva N2114 Archoma) | 5.97 | 0.18 |
| Standard Viscose (Control finished fiber) | 10.5 | 3.18 |
| Ex. 1- Viscose + 1% INV1 | 9.63 | 2.63 |
| Ex. 2- Viscose + 0.5% INV1 | 9.91 | 2.82 |

TABLE 3-continued

| frictional properties of fiber | | |
|---|---|---|
| Example (Ex) No. | Peak at Force (N) | Scroop (N) |
| Ex. 3- Viscose + 0.25% INV1 | 10.61 | 3.01 |
| Ex. 4- Viscose (Dull nonwoven) + 1% INV1 | 11.04 | 3.14 |
| Ex. 5- Lyocell + 1% INV1 | 9.33 | 2.49 |
| Ex. 6- Dope dyed + 1% INV1 | 9.50 | 3.14 |

The following examples illustrate the role of cationic polymer and metal salts in obtaining hydrophobic cellulosic fiber with desired frictional properties.

Example 7

20 gm of wet (100% moisture on dry fiber basis) unfinished (finish never applied) viscose staple fiber has been taken for the application. 200 ml water containing 1% INV1 on active (solids) basis was poured/sprayed on fiber using MLR-1:20, for 2 minutes. Further, this treated fiber was passed through padding mangle to control final moisture 100% on dry fiber basis (INV1 1% on fiber). Then dried at 105° C. for 20 minutes in oven. The dried fiber has been washed with cold water (just dipped for 2 minutes and then rinse) to remove metal salt and cationic polymer and again dried in oven at 105° C. for 20 minutes.

It was observed that although the resultant fiber showed good hydrophobicity, the fiber was extra soft.

Table 4 below shows the frictional properties of the fiber obtained after washing the cationic polymer and the metal salt.

TABLE 4

| Sledge test results | | | |
|---|---|---|---|
| S. No. | Samples | Force at Peak (N) | Scroop (N) |
| 1 | Viscose + 1% INV1 | 9.8 | 2.7 |
| 2 | Ex. 7 Viscose + 1% INV1 after water wash | 5.6 | 0.5 |

Example 8

The washed fiber from Example 7 was treated with 0.1% aqueous solution of aluminum sulfate and 0.16% Poly-DADMAC. Herein, 10 gm water washed and dried viscose staple fiber from Example 7 was taken for the application. 200 ml 0.1% aqueous aluminum sulfate and 0.16% Poly-DADMAC was poured/sprayed on fiber using MLR-1:20, for 2 minutes. Further, this aluminum sulfate and Poly-DADMAC applied fiber was passed through padding mangle to control final moisture 100% on dry fiber basis (0.1% aluminum sulfate+0.16 poly DADMAC on fiber). Then the fiber was dried at 105° C. for 20 minutes in oven.

It was observed that the resultant dried fiber showed good hydrophobicity with improvement in frictional properties as compared to the water washed fiber in Example 7. Table 5 below shows the frictional properties of the fiber obtained in Example 7 as well as the fiber obtained after treatment with the metal salt.

TABLE 5

| Sledge test result | | | |
|---|---|---|---|
| S. No. | Samples | Force at Peak (N) | Scroop (N) |
| 1 | Viscose + 1% INV1 after water wash (from Example 7) | 5.6 | 0.5 |
| 2 | Fiber from Example 7 treated with 0.1% aluminium sulphate + 0.16% Poly DADMAC | 8.5 | 1.2 |

The above Example 8 shows that the treatment of fiber from Example 7 with the metal salt and polymeric cationic additives significantly increases the fiber-fiber friction in the fiber. Examples 9-11 show the result when fiber is subject to treatment with a hydrophobic composition comprising AKD with metal salt (Aluminium sulfate) and the polymeric cationic compound (Poly-DADMAC) individually and in combination.

Example 9

20 gm of wet (100% moisture on dry fiber basis) unfinished (finish never applied) viscose staple fiber (VSF) has been taken for the application. 200 ml water containing of 1% AKD solution (obtained from commercial source-Novasize-1500 AKD) on an active basis and 0.1% Aluminium sulphate was poured/sprayed on fiber (MLR 1:20) for 2 minutes, further this treated fiber was passed through padding mangle to control final moisture 100% on dry fiber basis (1% AKD solution and 0.1% Aluminium sulphate on fiber). Then fiber was dried at 105° C. for 20 minutes in the oven. The resultant fiber showed good hydrophobicity and frictional attributes of the fiber are explained in Table 5.

Example 10

20 gm of wet (100% moisture on dry fiber basis) unfinished (finish never applied) viscose staple fiber (VSF) has been taken for the application. 200 ml water containing 1% AKD solution (obtained from commercial source-Novasize-1500 AKD) on an active basis and 0.16% Poly-DADMAC (Polymeric cationic additive) on the active basis was poured/sprayed on fiber (MLR 1:20) for 2 minutes. Further, this treated fiber was passed through padding mangle to control final moisture 100% on dry fiber basis (1% AKD solution and 0.16% Poly-DADMAC on fiber). Then dried at 105° C. for 20 minutes in the oven. The resultant fiber showed good hydrophobicity and frictional attributes for the said fiber are explained in Table 5.

Example 11

20 gm of wet (100% moisture on dry fiber basis) unfinished (finish never applied) viscose staple fiber (VSF) has been taken for the application. 200 ml water containing of 1% AKD solution (obtained from commercial source-Novasize-1500 AKD) on active basis, 0.1% Aluminium sulphate, and 0.16% Poly-DADMAC on the active basis was poured/sprayed on fiber (MLR 1:20) for 2 minutes, this treated fiber was passed through padding mangle to control final moisture 100% on dry fiber basis (1% AKD solution, 0.1% Aluminium sulphate, and 0.16% Poly-DADMAC on fiber). Then dried at 105° C. for 20 minutes in the oven. The resultant fiber showed good hydrophobicity and frictional attributes for the said fiber are explained in Table 5.

TABLE 6

Sledge test Result

| Samples | Friction Force (N) | Scroop (N) | Hydrophobic rating |
|---|---|---|---|
| Ex. 9: 1% AKD + 0.1% Aluminium sulfate | 7.9 | 2.2 | 10 |
| Ex 10: 1% AKD + 0.16% Poly-DADMAC | 8.5 | 2.1 | 10 |
| Ex 11: 1% AKD + 0.1% Aluminium sulfate + 0.16% Poly-DADMAC | 9.4 | 2.65 | 10 |

Example 12

Viscose Staple fiber was produced on commercial line (continuous viscose production line) wherein the hydrophobic composition was applied prior to dryer on unfinished fiber (finish never applied fiber) as per the procedure mentioned in Example 4. The moisture level of fiber was maintained before and after application of INV1 emulsion as per Example 4. It was observed that the resultant fiber showed good hydrophobicity rating of 10 with a frictional force of 11.08 N and scroop of 3.14 N.

Further, this fiber was converted to non-woven fabric using hydro entanglement process to see the hydrophobic performance at fabric stage. The obtained fabric showed hydrophobic performance of rating 10, as per Example 4. Further, this fabric was tested for different parameters. Table 6 below shows the properties of the obtained hydrophobic fabric vis-à-vis conventional viscose fabric obtained from standard viscose staple fiber (Spunlace fabric having 50 gsm) without the treatment with hydrophobic composition of present invention.

TABLE 7

Fabric Properties (Regular viscose fabric vis-à-vis Hydrophobic fabric)

| Sr. No | Test Method | Regular viscose fabric | Hydrophobic fabric |
|---|---|---|---|
| 1 | Contact Angle (degree) Requirement: >90 degree | 69 | >90 |
| 2 | Liquid strike through time- Lister time (sec) Higher for hydrophobic material | 2.6 | 160 |
| 3 | Wetback test (after strike, gm of water still remaining on fabric) Should be minimum | 0.76 | 0.06 |
| 4 | Liquid Wicking rate (Height of water Absorbed (cm)) | Not done | No wicking observed |
| 5 | Spray Test Rating (IS 390: 1975: RA2013)- 100 is super hydrophobic | | 70 |

Table 7 depicts that fabric obtained from hydrophobic fiber shows desirable hydrophobic properties like Contact angel >90°, Liquid strike through time being 160 seconds in comparison to regular viscose being 2.6 seconds. No wicking is observed in hydrophobic fabric which is one of important attribute for usage in several nonwoven applications.

Figure 3A:
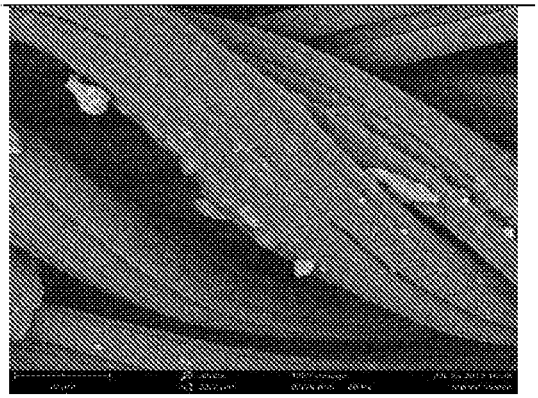
FIGS. 3A, 3B, and 3C show the Scanning Electron Microscopy (SEM) images of regular VSF fabric when subjected to soil degradation at $1^{st}$, $2^{nd}$ and $3^{rd}$ week respectively.
Figure 4A:
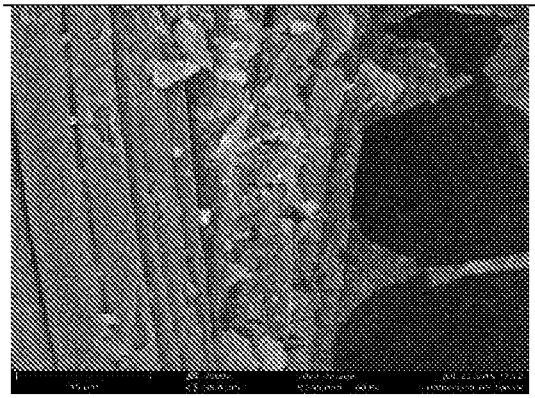
FIGS. 4A, 4B and 4C show the SEM images of 100% hydrophobic VSF fabric when subjected to soil degradation at 1st, $2^{nd}$ and $3^{rd}$ week respectively.
Figure 3B:
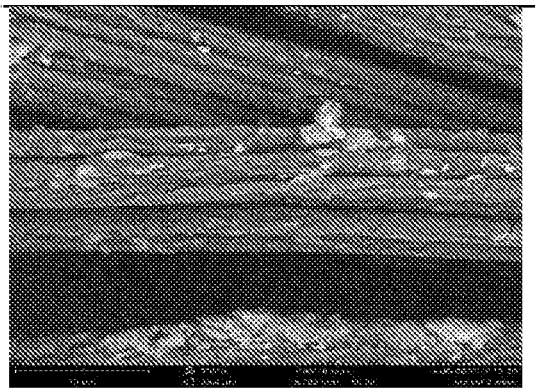
Figure 4B:
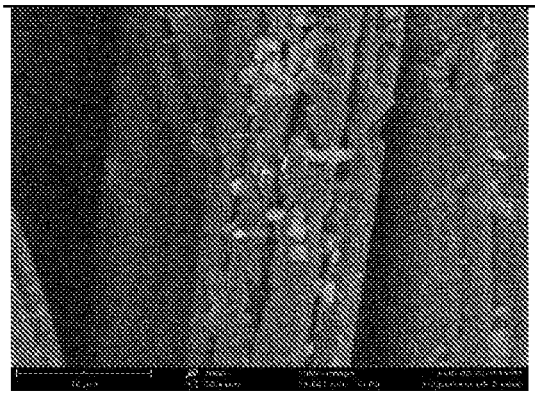
Figure 3C:
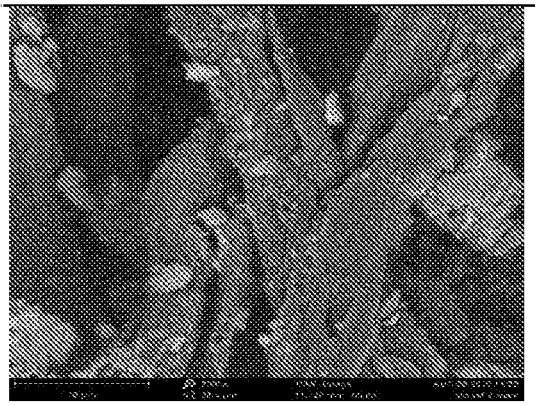
Figure 4C:
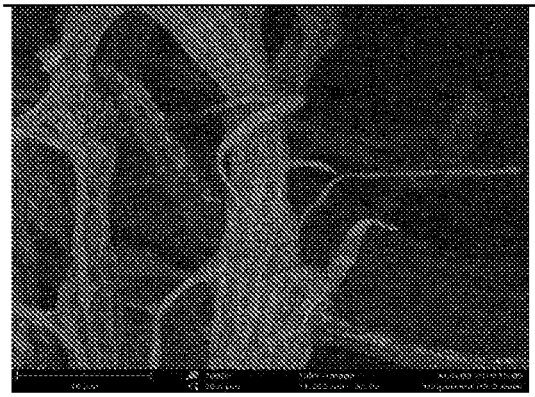

Further, the Nonwoven fabric prepared from the disclosed fiber has been tested for soil biodegradation in comparison with fabric obtained from regular Viscose Staple fiber. FIGS. 1A, 1B, 1C and 1D show the camera images of regular VSF fabric at $1^{st}$, $2^{nd}$, $3^{rd}$ and $4^{th}$ week respectively. FIGS. 2A, 2B, 2C and 2D and show the camera images of 100% Hydrophobic VSF fabric at $1^{st}$, $2^{nd}$, $3^{rd}$ and $4^{th}$ week respectively. FIGS. 3A, 3B, and 3C show the Scanning Electron Microscopy (SEM) images of regular VSF fabric at $1^{st}$, $2^{nd}$ and $3^{rd}$ week respectively. FIGS. 4A, 4B and 4C and show the SEM images of 100% hydrophobic VSF fabric at $1^{st}$, $2^{nd}$ and $3^{rd}$ week respectively.

It was observed that almost complete degradation takes place in 4 weeks. Scanning Electron Microscopy also confirms loss in fiber structure in 3 week and sample was not available for test in $4^{th}$ week.

INDUSTRIAL APPLICABILITY

The disclosed process imparts hydrophobic properties to regenerated cellulose fibers, while maintaining their frictional properties similar to regenerated cellulosic fiber without the treatment with hydrophobic composition.

Owing to frictional properties of disclosed hydrophobic regenerated cellulosic fibers, said fibers can be easily spun in the existing nonwoven spinning machines without any additional equipment or changes in the machinery. To run the fiber on processing machines, it is required that almost all the fiber processing machines are designed and optimized as per standard fiber to get the maximum production output. For this, it is required that the cohesiveness of any fiber is as per standard viscose fiber (commercial grade finish fiber). The cohesion of the fiber is important for controlled carding operation at high speeds, web removal from machine, web integrity, web laying and for achieving strength in final fabric. Lower cohesion may lead to uncontrolled movement of fiber in card, patchy web, stretch in web and web breaks during transfer to subsequent spun-lacing process or needle punching process. Said fibers have cohesion compared to standard untreated fibers and thus no change in machinery is required for processing of said fibers.

The disclosed process enables use of biodegradable cellulosic fibers in applications requiring hydrophobic synthetic fibers. Further, the process uses chemicals approved by FDA and are environmentally safe. Thus, the present process has significantly low carbon footprint and is environment friendly.

The disclosed process is a continuous process and is cost effective. As the hydrophobicity can be achieved at fiber stage itself, use of any of the other hydrophobic agent at fabric stage becomes unnecessary. Additionally, the hydrophobicity as well as the desired frictional properties remain consistent through the various stages of fabric manufacturing.

The disclosed hydrophobic fibers can be blended with other fibers like cotton, standard Viscose Staple Fiber, lyocell, synthetic fibers (e.g., polyester or polypropylene fibers), Polylactic acid (PLA) etc. The disclosed fiber can be used to manufacture masks, towels, and bed sheets or bed liners for use in hospitals; hygiene products such as diapers, personal healthcare, hygiene, and agricultural covers; sportswear, covers, caps etc.; packaging in food industry or packaging that needs water repellency; hydrophobic wipes and the like.

Further, the disclosed hydrophobic fibers can be used to manufacture suitable nonwoven top layer of personal hygiene products, and in particular sanitary napkins from a wide range of materials such as cotton, standard Viscose Staple Fiber, lyocell, polyester, Polylactic acid (PLA), synthetic fibers (e.g., polyester or polypropylene fibers) or from a combination of natural and/or synthetic fibers. Technical parameters like wetback (rewetting), liquid strike through time, bonding strength etc. of the disclosed fiber shows that the fiber can be used to form top layer or sheet of such products. Further, it was observed that said top layer formed by disclosed fiber remains pervious to liquids and yet non-absorbent as well as meets the requirements of biodegradability. Thus, use of the disclosed fiber to form top layer of hygiene products keeps the body dry, thereby reducing body soiling and creating a more comfortable feel for the wearer.

We claim:

1. A continuous process for preparing hydrophobic cellulosic fiber, said process comprising treating never-dried cellulosic fiber with a hydrophobic composition comprising:

0.05-2.5 weight % of an alkyl ketene dimer based on weight of cellulose, the alkyl ketene dimer having a formula I:

formula I

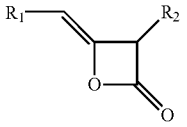

wherein both R1 and R2 are hydrocarbon groups having 8-40 carbon atoms and which can be both, saturated or unsaturated, straight-chained or branched;

0.02-1 weight % of a cationic polymer based on weight of cellulose, followed by drying the treated fiber to form hydrophobic regenerated cellulose fiber, such that the hydrophobic regenerated cellulosic fiber has a fiber-fiber friction of at least 7.0 N (peak at force), measured in accordance with sledge test (ANSI/ASTM D 1894-78).

2. The process as claimed in claim 1, wherein the cationic polymer is a polymeric quaternary ammonium compound selected from a group consisting of Poly(diallyldimethylammonium chloride), Poly(acrylamide-co-diallyldimethylammonium chloride) and cationic starch.

3. The process as claimed in claim 1, wherein the hydrophobic composition further comprises 0.01-0.5 weight % of a metal salt based on weight of cellulose.

4. The process as claimed in claim 3, wherein the metal salt is selected from a group consisting of aluminum sulphate, magnesium sulphate, sodium sulphate, sodium chloride.

5. The process as claimed in claim 1, wherein the treatment is carried out for a time-period of 30 seconds to 5 minutes.

6. The process as claimed in claim 1, wherein the hydrophobic composition comprises the alkyl ketene dimer in an amount ranging between 0.2-1.5%.

7. The process as claimed in claim 1, wherein the hydrophobic composition comprises the cationic polymer in an amount ranging between 0.08-0.6%.

8. The process as claimed in claim 3, wherein the hydrophobic composition comprises the metal salt in an amount ranging between 0.04-0.35%.

9. The process as claimed in claim 1, wherein the hydrophobic regenerated cellulosic fiber has a fiber-fiber friction in a range of 7.0-14.0 N (peak at force).

10. A hydrophobic regenerated cellulosic fiber comprising a hydrophobic composition absorbed thereon, the hydrophobic composition comprising:

0.05-2.0 weight % of an alkyl ketene dimer based on weight of cellulose, the alkyl ketene dimer having a formula I:

formula I

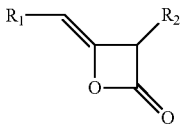

wherein both R1 and R2 are hydrocarbon groups having 8-40 carbon atoms and which can be both, saturated or unsaturated, straight-chained or branched; and 0.08-0.5 weight % of a cationic polymer;

such that the hydrophobic regenerated cellulosic fiber has a fiber-fiber friction of at least 7.0 measured in accordance with sledge test (ANSI/ASTM D 1894-78).

11. The hydrophobic regenerated cellulosic fiber as claimed in claim 10, wherein the hydrophobic regenerated cellulosic fiber has the fiber-fiber friction in a range of 7.0-12.0 N (peak at force).

12. The hydrophobic regenerated cellulosic fiber as claimed in claim 11, wherein the hydrophobic regenerated cellulosic fiber has the fiber-fiber friction in a range of 8.5-11.0 N (peak at force).

13. The hydrophobic regenerated cellulosic fiber as claimed in claim 10, wherein the cationic polymer is a polymeric quaternary ammonium compound selected from a group consisting of Poly(diallyldimethylammonium chloride), Poly(acrylamide-co-diallyldimethylammonium chloride) and cationic starch.

14. The hydrophobic regenerated cellulosic fiber as claimed in claim 10, wherein the hydrophobic composition further comprises 0.01-0.5 weight % of a metal salt based on weight of cellulose.

15. The hydrophobic regenerated cellulosic fiber as claimed in claim 13, wherein the metal salt is selected from a group consisting of aluminum sulphate, magnesium sulphate, sodium sulphate, sodium chloride.

16. The hydrophobic regenerated cellulosic fiber as claimed in claim 10, wherein the hydrophobic composition comprises the alkyl ketene dimer in an amount ranging between 0.2-1.5%.

17. The hydrophobic regenerated cellulosic fiber as claimed in claim 10, wherein the hydrophobic composition comprises the cationic polymer in an amount ranging between 0.08-0.6%.

18. The hydrophobic regenerated cellulosic fiber as claimed in claim 14, wherein the hydrophobic composition comprises 0.04-0.25 weight % of a metal salt based on weight of cellulose.

19. A product comprising the hydrophobic regenerated cellulosic fiber as claimed in claim 10.

20. The product as claimed in claim 19, wherein the product is a multi-layer article and comprises a top layer comprising said hydrophobic regenerated cellulosic fiber.

* * * * *